US010690126B2

(12) United States Patent
Gamble

(10) Patent No.: US 10,690,126 B2
(45) Date of Patent: Jun. 23, 2020

(54) DUAL ENGINE-COMPRESSOR SYSTEM

(71) Applicant: KISS-Engineering Inc., Northridge, CA (US)

(72) Inventor: Christopher L. Gamble, Canoga Park, CA (US)

(73) Assignee: KISS-Engineering Inc., Northridge, CA (US)

( * ) Notice: Subject to any disclaimer, the term of this patent is extended or adjusted under 35 U.S.C. 154(b) by 191 days.

(21) Appl. No.: 16/052,052

(22) Filed: Aug. 1, 2018

(65) Prior Publication Data

US 2020/0040880 A1 Feb. 6, 2020

(51) Int. Cl.

| | |
|---|---|
| ***F04B 35/00*** | (2006.01) |
| ***F02B 75/00*** | (2006.01) |
| ***F02B 63/06*** | (2006.01) |
| ***F02B 75/20*** | (2006.01) |
| ***F04B 39/12*** | (2006.01) |
| ***F04B 39/00*** | (2006.01) |
| ***F04B 39/10*** | (2006.01) |
| ***F04B 25/00*** | (2006.01) |
| ***F02B 33/02*** | (2006.01) |
| ***F01B 9/02*** | (2006.01) |

(Continued)

(52) U.S. Cl.

CPC ..... *F04B 35/002* (2013.01); *F01B 9/023* (2013.01); *F02B 33/02* (2013.01); *F02B 63/06* (2013.01); *F02B 75/002* (2013.01); *F02B 75/20* (2013.01); *F04B 25/005* (2013.01); *F04B 27/02* (2013.01); *F04B 39/0005* (2013.01); *F04B 39/0094* (2013.01); *F04B 39/1073* (2013.01); *F04B 39/12* (2013.01); *F04B 39/128* (2013.01); *F02B 2075/1808* (2013.01)

(58) Field of Classification Search

CPC ..... F04B 35/002; F04B 25/00; F04B 27/02; F04B 39/0094; F04B 39/128; F04B 41/06; F02B 63/06; F02B 33/02; F01B 9/023; F01B 1/08; F01B 1/10; F01B 9/026; F01B 3/0035; F02D 23/005; F02G 2280/50; Y10T 74/18256

See application file for complete search history.

(56) References Cited

U.S. PATENT DOCUMENTS 2,628,015 A * 2/1953 Neugebauer ..... F04B 25/00 417/203

4,705,460 A * 11/1987 Braun ..... F02B 71/04 123/46 SC (Continued)

*Primary Examiner* — Dominick L Plakkoottam

(74) *Attorney, Agent, or Firm* — Kelly & Kelley, LLP

(57) ABSTRACT

The present invention is directed to a dual engine-compressor system having a crankcase enclosing a crankshaft and having engine cylinder housings and compressor cylinder housings linearly disposed on opposite sides of the crankcase. Combustion pistons are reciprocatingly disposed in the engine cylinder housings and defines alternating combustion chambers on opposite sides of the pistons. Compressor pistons are reciprocatingly disposed in the compressor housings and define alternating low and high pressure compressor chambers on opposite sides of the compressor pistons. The compressor pistons underdo a 4-cycle process to drawn in, re-distribute, and then compress fluid. The compressor cylinder and piston has a series of one-way intakes and reed valves to selectively draw or push fluid in response to movement of the compressor piston.

13 Claims, 18 Drawing Sheets

(51) Int. Cl.
*F04B 27/02* (2006.01)
*F02B 75/18* (2006.01)

(56) References Cited

U.S. PATENT DOCUMENTS

| | | | | | |
|---|---|---|---|---|---|
| 4,811,558 | A * | 3/1989 | Baugh | F04B 25/00 | 417/267 |
| 5,400,751 | A * | 3/1995 | Grimmer | F04B 25/00 | 123/192.2 |
| 5,702,238 | A * | 12/1997 | Simmons | F01B 9/023 | 417/380 |
| 6,662,775 | B2 * | 12/2003 | Hauser | F01B 3/0035 | 123/241 |
| 7,503,291 | B2 * | 3/2009 | Gamble | F01B 1/08 | 123/197.3 |
| 9,957,958 | B2 * | 5/2018 | Deffenbaugh | F04B 27/12 | |
| 2005/0145207 | A1 * | 7/2005 | Thomas | F01B 3/0005 | 123/48 R |
| 2007/0079778 | A1 * | 4/2007 | Atkinson | F02B 63/06 | 123/62 |
| 2012/0227389 | A1 * | 9/2012 | Hinderks | F01L 13/0042 | 60/317 |
| 2015/0300242 | A1 * | 10/2015 | Scalzo | F02B 25/08 | 123/18 R |
| 2016/0341187 | A1 * | 11/2016 | Buffa | F04B 35/002 | |
| 2017/0254320 | A1 * | 9/2017 | Schulze | F01B 13/068 | |

* cited by examiner

DUAL ENGINE-COMPRESSOR SYSTEM

BACKGROUND OF THE INVENTION

The present invention is directed to an improved dual engine-compressor system that Is compact and efficient. In particular, the dual engine-compressor is a straight-line reciprocating device where each engine piston is dual-sided and each compressor piston pressurizes and refills with each stroke.

Various types of engine designs have been developed over the years. The most common engine is the conventional reciprocating piston internal combustion engine in which a reciprocating piston is coupled by a connecting rod to the offset crank pins of a crankshaft. The reciprocating motion of the pistons is translated to rotary motion at the crank shaft. Power is delivered by the crank shaft to the driven device such as a vehicle or in stationary application to a pump or other device.

A wide variety of alternate engine designs have been developed over the years in attempts to improve upon the basic engine design described above. These devices may change the cycle dynamics of the engine. Another prior design employs a scotch yoke. While scotch yoke designs provide a means of converting the reciprocating linear piston motion to rotary motion, practical problems are that they tend to suffer from drawbacks, including excessive vibration, frictional losses and wear.

Other straight-line, reciprocating systems are known to exist, including U.S. Pat. Nos. 7,503,291, 8,109,737, and 9,406,083—all for a reciprocating device with dual chambered cylinders. One major drawback of these systems is that they are either an engine or a compressor—not both at the same time.

Accordingly, there is a need for an improved and compact dual engine-compressor system that can simultaneously function as an engine and a compressor. The present invention fulfills these needs and provides other related advantages.

SUMMARY OF THE INVENTION

The present invention relates to a new and novel reciprocating device which may be operated either as a combustion engine or as a compressor. As an engine, the device is highly efficient having a high power-to-weight ratio, reduced cylinder friction, reduced vibration, reduced pollution. Lubrication requirements are also minimized.

The engine design of the invention is extremely versatile and compact and allows for convenient increase in size and horsepower by addition of additional cylinders by addition of basic components with major modifications. The design utilizes fewer components than conventional IC engine designs and each cylinder has a piston with cylinder chambers disposed on opposite sides of the piston so the engine essentially "fires" every half stroke.

The present invention is directed to a dual engine-compressor system. The system includes a crankcase enclosing a crankshaft and having at least a first engine cylinder housing disposed on a first side of the crankcase and a first compressor cylinder housing disposed on an opposite second side of the crankcase. The first engine cylinder housing defines a first engine bore and the first compressor cylinder housing defines a first compressor bore.

A first combustion piston is reciprocatingly disposed in the first engine bore and defines alternating combustion chambers within the first engine bore on opposite sides of the first combustion piston. A first compressor piston is reciprocatingly disposed in the first compressor bore and defines alternating compressor chambers within the first compressor bore on opposite sides of the first compressor piston. A first combustion rod connects the first combustion piston to a first scotch yoke on the crankshaft and a first compressor rod connects the first compressor piston to the first scotch yoke. The first combustion rod and the first compressor rod are oriented in a generally linear relationship.

The alternating compressor chambers in the first compressor bore comprise a low-pressure chamber and a high-pressure chamber. The low pressure chamber has a first diameter and the high-pressure chamber has a second diameter that is smaller than the first diameter. The first compressor piston has a cylindrical body and a cylindrical cap. The cylindrical body has a diameter equal to the second diameter of the high-pressure chamber. The cylindrical cap has a diameter equal to the first diameter of the low-pressure chamber.

A fluid intake is included on the low-pressure chamber of the first compressor housing and an intake reed valve is associated with the fluid intake. The intake reed valve is configured to open the fluid intake on an upstroke of the first compressor piston and close the fluid intake on a downstroke of the first compressor piston.

A low-pressure intake is included through the cylindrical cap of the first compressor piston and a low-pressure reed valve is associated with the low-pressure intake. The low-pressure reed valve is configured to open the low-pressure intake on a downstroke of the first compressor piston and close the low-pressure intake on an upstroke of the first compressor piston.

A high-pressure intake is included through the cylindrical body of the first compressor piston and a high-pressure reed valve is associated with the high-pressure intake. The high-pressure reed valve is configured to open the high-pressure intake on an upstroke of the first compressor piston and close the high-pressure intake on a downstroke of the first compressor piston.

The first compressor piston is configured to reciprocate between an upstroke position, with the first compressor piston substantially within the low-pressure chamber, and a downstroke position, with the first compressor piston substantially within the high-pressure chamber. Movement of the first compressor piston from the downstroke position to the upstroke position causes compressor fluid to be drawn through a fluid intake from outside the first compressor housing through the fluid intake and into the low-pressure chamber—in the area between the fluid intake and the cylindrical cap.

Movement of the first compressor piston from the upstroke position to the downstroke position causes compressor fluid to be forced through a low-pressure intake from one side of the cylindrical cap to another side of the cylindrical cap, i.e., into the area between the cylindrical cap and the crankcase.

A second movement of the first compressor piston from the downstroke position to the upstroke position causes compressor fluid to be forced through a high-pressure intake from the low-pressure chamber to the high-pressure chamber, i.e., from the area between the cylindrical cap and the crankcase to the high-pressure chamber. A second movement of the first compressor piston from the upstroke position to the downstroke position causes compressor fluid in the high-pressure chamber to be compressed until released through a compressor outlet.

The first compressor piston may have a plurality of magnets disposed around a perimeter of the piston cylindrical body. The first compressor cylinder housing may have a plurality of pick-ups disposed around the high-pressure chamber. In this configuration, each of the plurality of magnets is associated with at least one of the plurality of pick-ups.

A second engine cylinder housing may be disposed on the first side of the crankcase and define a second engine bor. A second combustion piston may be reciprocatingly disposed in the second engine bore and define alternating combustion chambers within the second engine bore on opposite sides of the second combustion piston.

A second compressor cylinder housing may be disposed on the second side of the crankcase and define a second compressor bore. A second compressor piston may be reciprocatingly disposed in the second compressor bore and define alternating compressor chambers within the second compressor bore on opposite sides of the second compressor piston.

A second combustion rod may connect the second combustion piston to a second scotch yoke on the crankshaft. A second compressor rod may connect the second compressor piston to the second scotch yoke. The second combustion rod and the second compressor rod are preferably oriented in a generally linear relationship.

The straight-line reciprocating system uses a scotch yoke or similar rectilinear rotary-motion translation device utilizing dual-chambered engine and compressor cylinders. The system operates simultaneously as an engine and as a compressor. On the engine-side, the system having two engine cylinder housings operates as a four-chamber combustion device and is compatible with various fuels such as gasoline, diesel, natural gas and propane. The reciprocating piston device provides high efficiency, high horsepower to weight ratios and reduced emissions. On the compressor-side, the system having two compressor cylinder housings operates as a four-chamber fluid compressor with high efficiency and volumetric capacity for its size.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
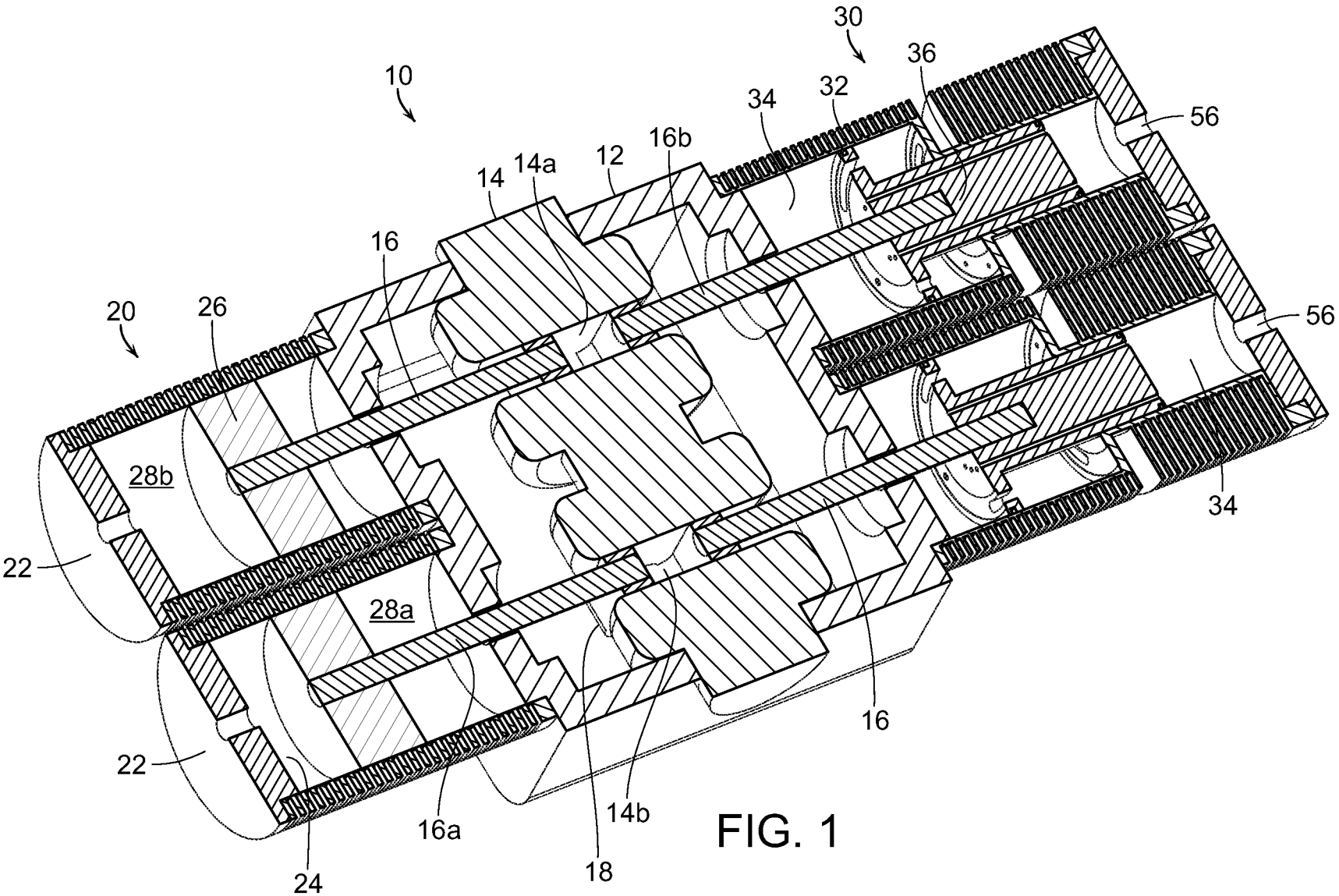
FIG. 1 is an elevated perspective, cross-sectional view of the dual engine-compressor system of the present invention.

In the following detailed description, the dual engine-compressor system of the present invention is generally referred to by reference numeral 10 in FIGS. 1-4. The main components and the structural relationship of the components of the dual engine-compressor system 10 are most clearly shown in FIGS. 1 and 2.

Figure 2:
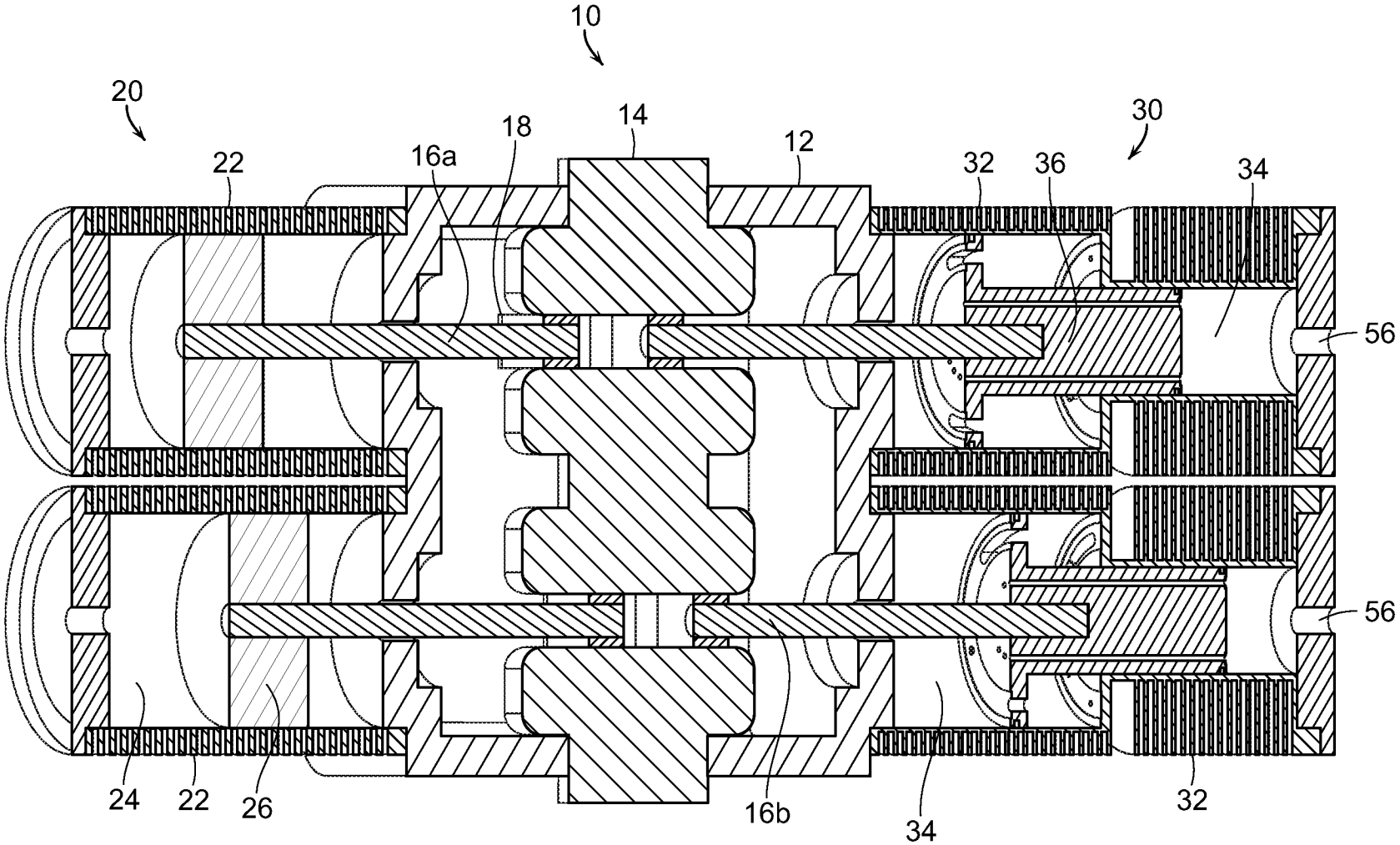
FIG. 2 is an elevated, cross-sectional view of the dual engine-compressor system of the present invention.

FIGS. 1 and 2 illustrate perspective cross-sectional views of the dual engine-compressor system 10. The system 10 comprises a central crankcase 12 enclosing a crankshaft 14 having connecting journals 14*a*, 14*b*. The crankshaft 14 is connected to linearly disposed piston rods 16 by a scotch yoke 18 or similarly functioning rectilinear, rotary-motion translation device.

An engine block 20 is disposed on one side of the crankcase 12. The engine block 20 includes one or more engine cylinder housings 22, each defining an engine bore 24 and containing a reciprocating engine piston 26 connected to one of the piston rods 16, specifically an engine piston rod 16*a*. Since the engine piston 26 is reciprocating, the engine bore 24 defines two combustion chambers 28*a*, 28*b*—with a single engine bore 24 and piston 26 being capable of two combustion strokes with each reciprocating motion. Each engine cylinder housing 22 and bore 24 contain air-fuel intakes (not shown), ignition devices (not shown), and exhaust ports (not shown) as are known in such combustion engines.

The engine bore 24 includes an exhaust port (not shown) in the middle of its length. As the piston 26 reciprocates through the bore 24, the exhaust port is alternately covered and exposed relative to one of the combustion chambers 28*a*, 28*b* on either side of the piston 26. The engine block 20 is preferably configured to time the injection of fuel/air with the movement of the piston 26 as follows. In a corresponding chamber 28*a*, 28*b* that has just undergone combustion, air is injected just prior to the returning piston 26 covering the exhaust port. In this way, the exhaust gases are pressurized when ejected from the cylinder allowing for muffling of the exhaust.

Once the piston 26 covers the exhaust port, the resulting pressure build-up in the chamber 28*a*, 28*b* keeps the air injector valve closed until the pressure is released through the exhaust port. As the piston 26 moves past the exhaust port, the pressure continues to build-up until the air injection valve is closed. The injection of fuel into the chamber 28*a*, 28*b* is timed with the compression once the piston 26 has covered the exhaust port.

Figure 3:
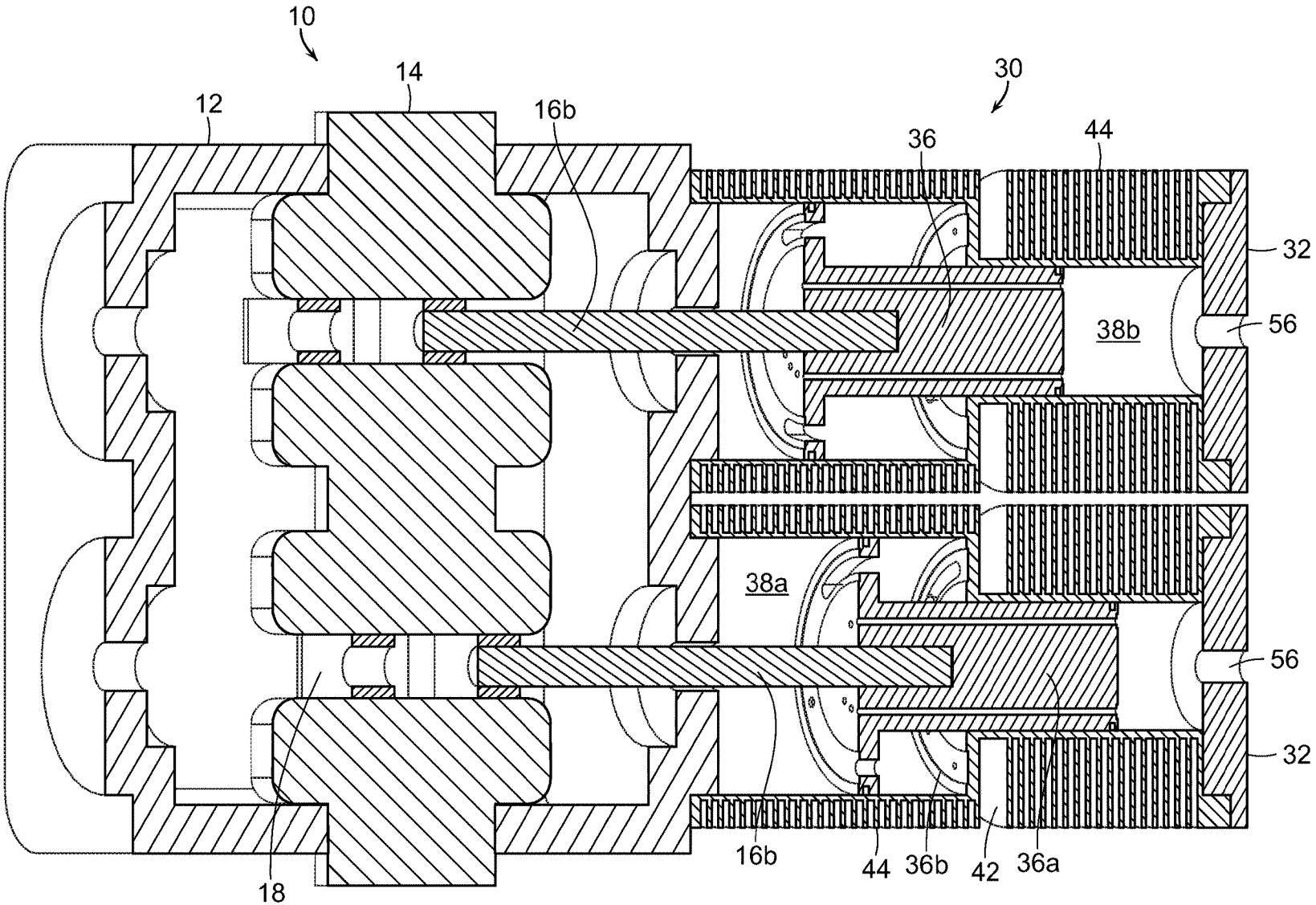
FIG. 3 is a close-up, cross-sectional view of the crankcase and compressor side of the dual engine-compressor system of the present invention.
Figure 4:
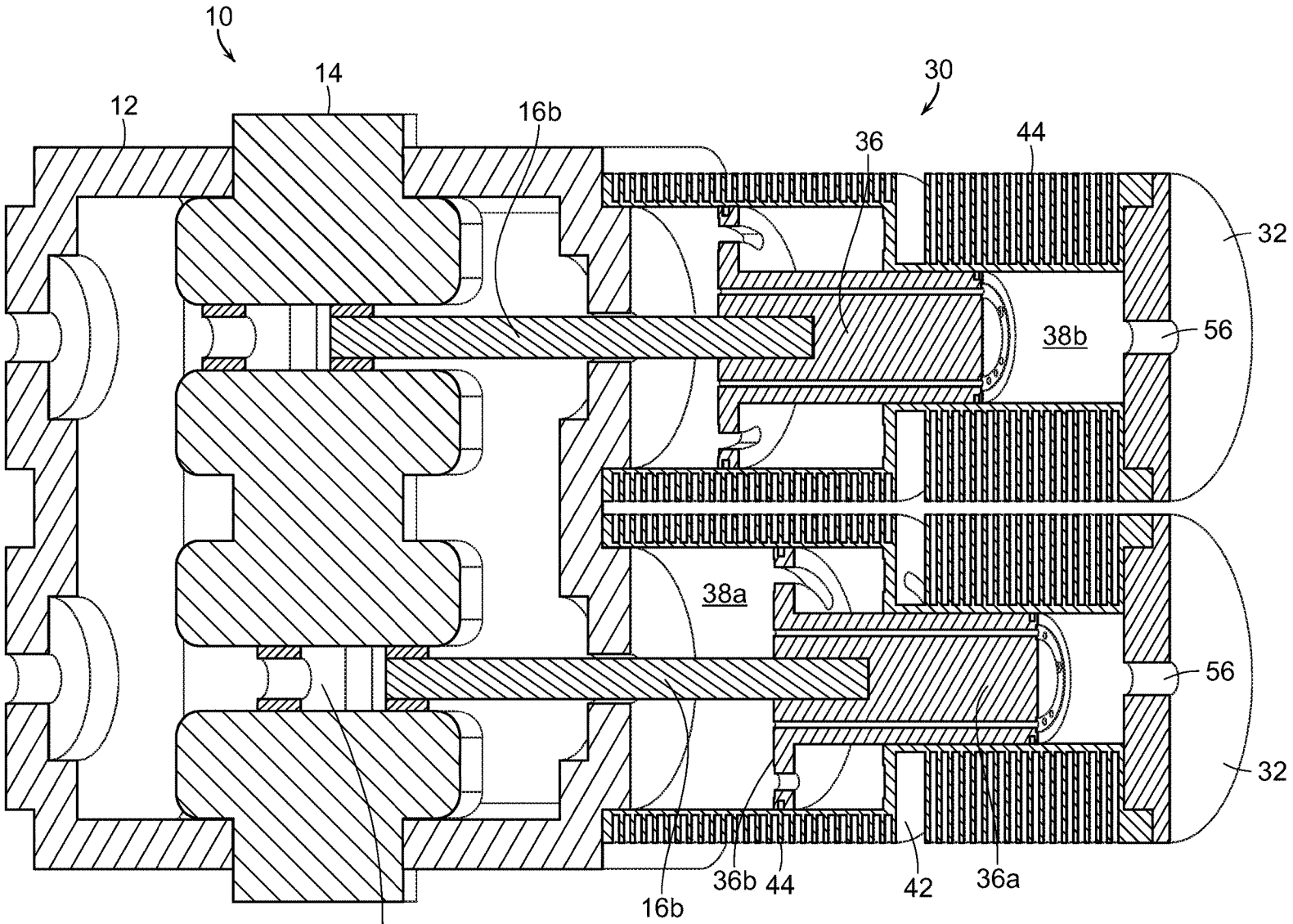
FIG. 4 is a close-up, cross-sectional view from the opposite angle as FIG. 3 of the crankcase and compressor side of the dual engine-compressor system of the present invention.
Figure 5:
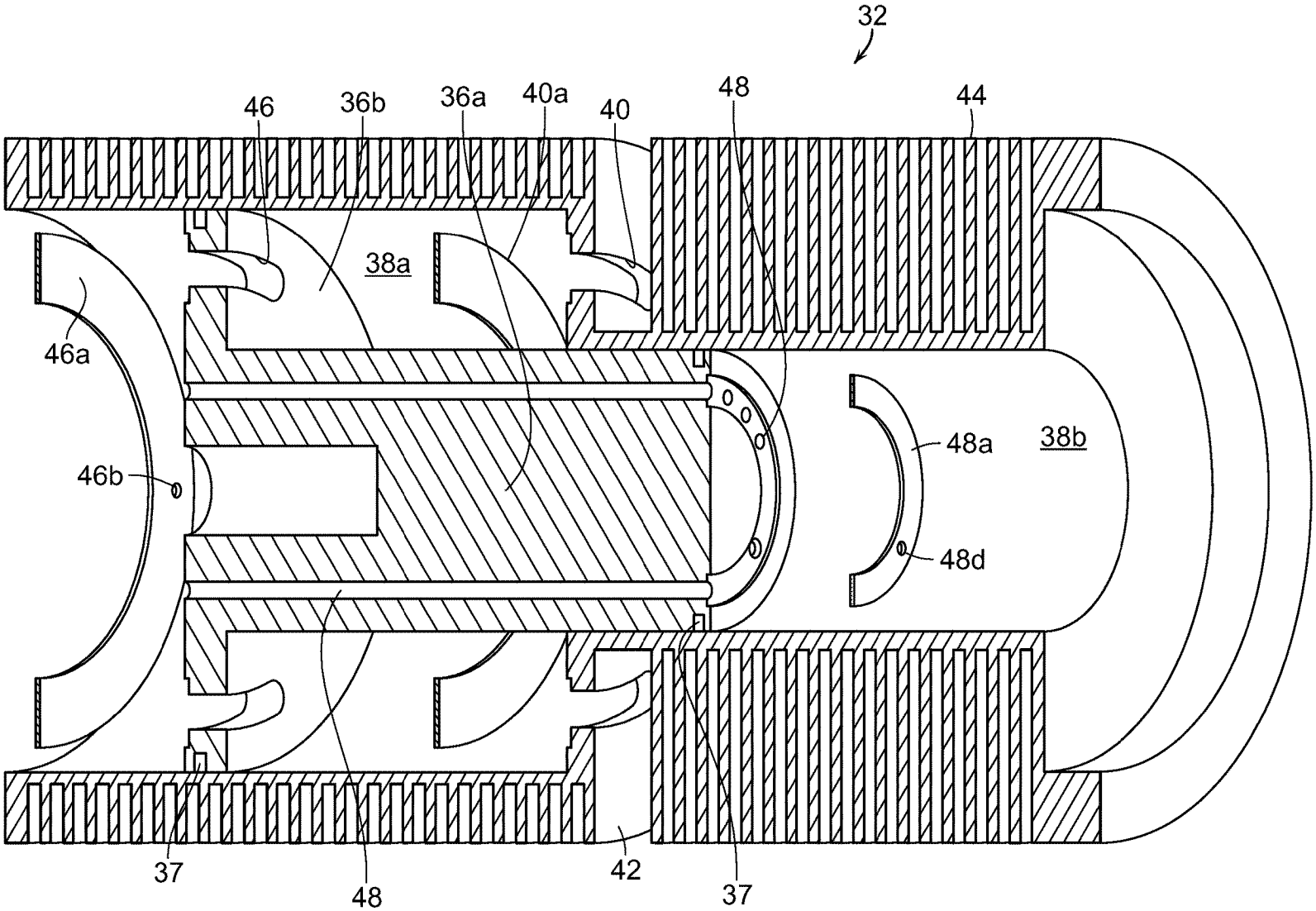
FIG. 5 is a cross-sectional, partially exploded view of the compressor cylinder and compressor piston of the dual engine-compressor system of the present invention.
Figure 6:
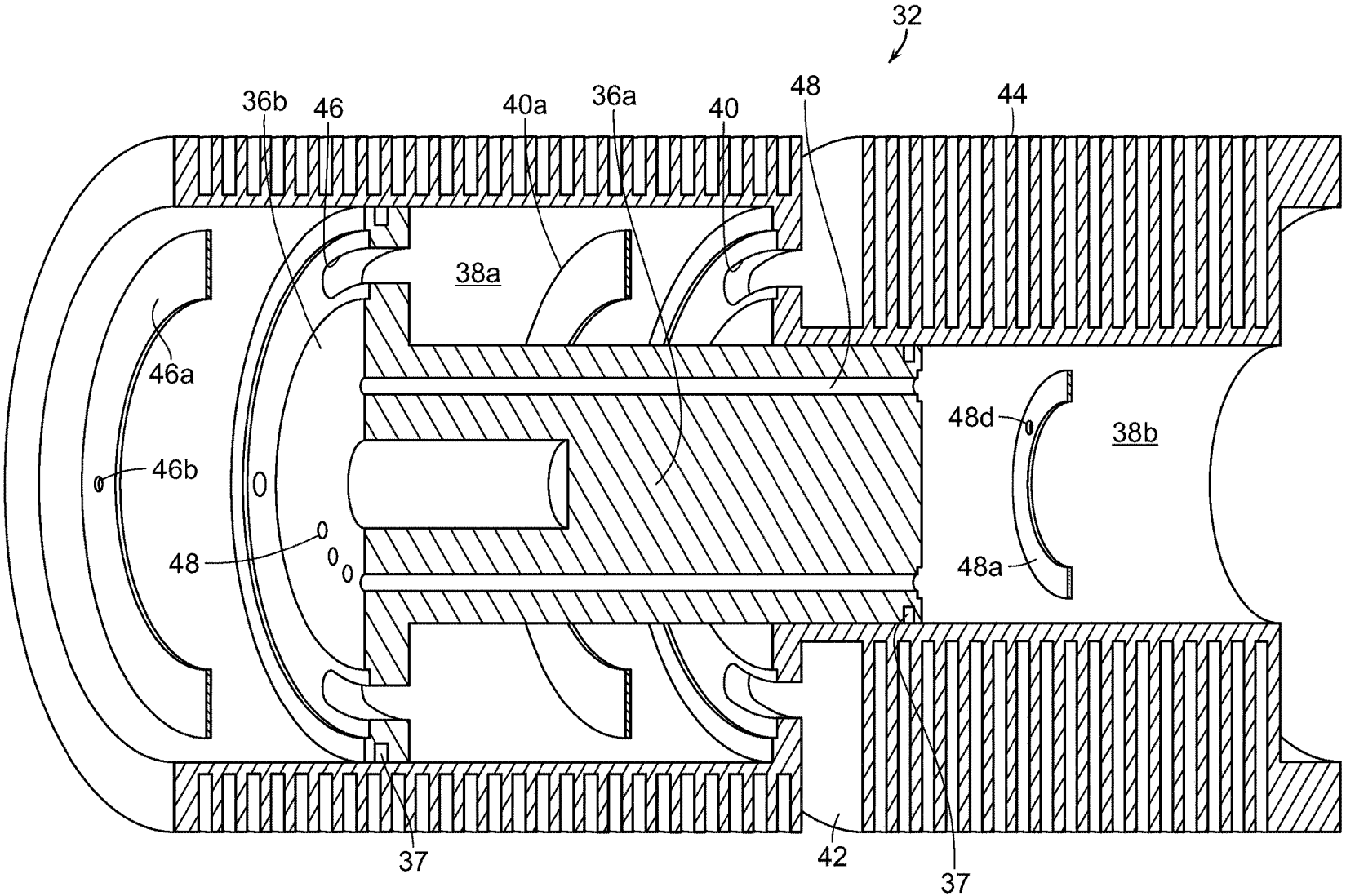
FIG. 6 is a cross-sectional, partially exploded view from the opposite angle of FIG. 5 of the compressor cylinder and compressor piston of the dual engine-compressor system of the present invention.

A compressor block 30, shown in FIGS. 3 and 4, is linearly and oppositely disposed on the crankcase 12 in comparison to the engine block 20. The compressor block 30 includes one or more compressor cylinder housings 32, each defining a compressor bore 34 and containing a reciprocating compressor piston 36 connected to one of the piston rods 16, specifically a compressor piston rod 16*b*. Since the compressor piston 36 is reciprocating, the compressor bore 34 defines two compressor chambers 38*a*, 38*b*—with a single compressor bore 34 and piston 36 being capable of two compressor strokes with each reciprocating motion. The compressor may function as either a gas/air compressor or a liquid/water compressor.

The engine piston rods 16*a* are connected in a straight line with the compressor piston rods 16*b* through the scotch yokes 18 on the crankshaft 14. All parts of the system 10 are preferably made from carbon fiber or similar material, except for the crankshaft 14, which must be made out of steel or similarly strong material for durability. In addition, because of the materials and manner of construction, there is no oil in either the engine block 20 or the compressor block 30. The only oil needed is in the crankcase 12 because of the material of the crankshaft 14.

Figure 7:
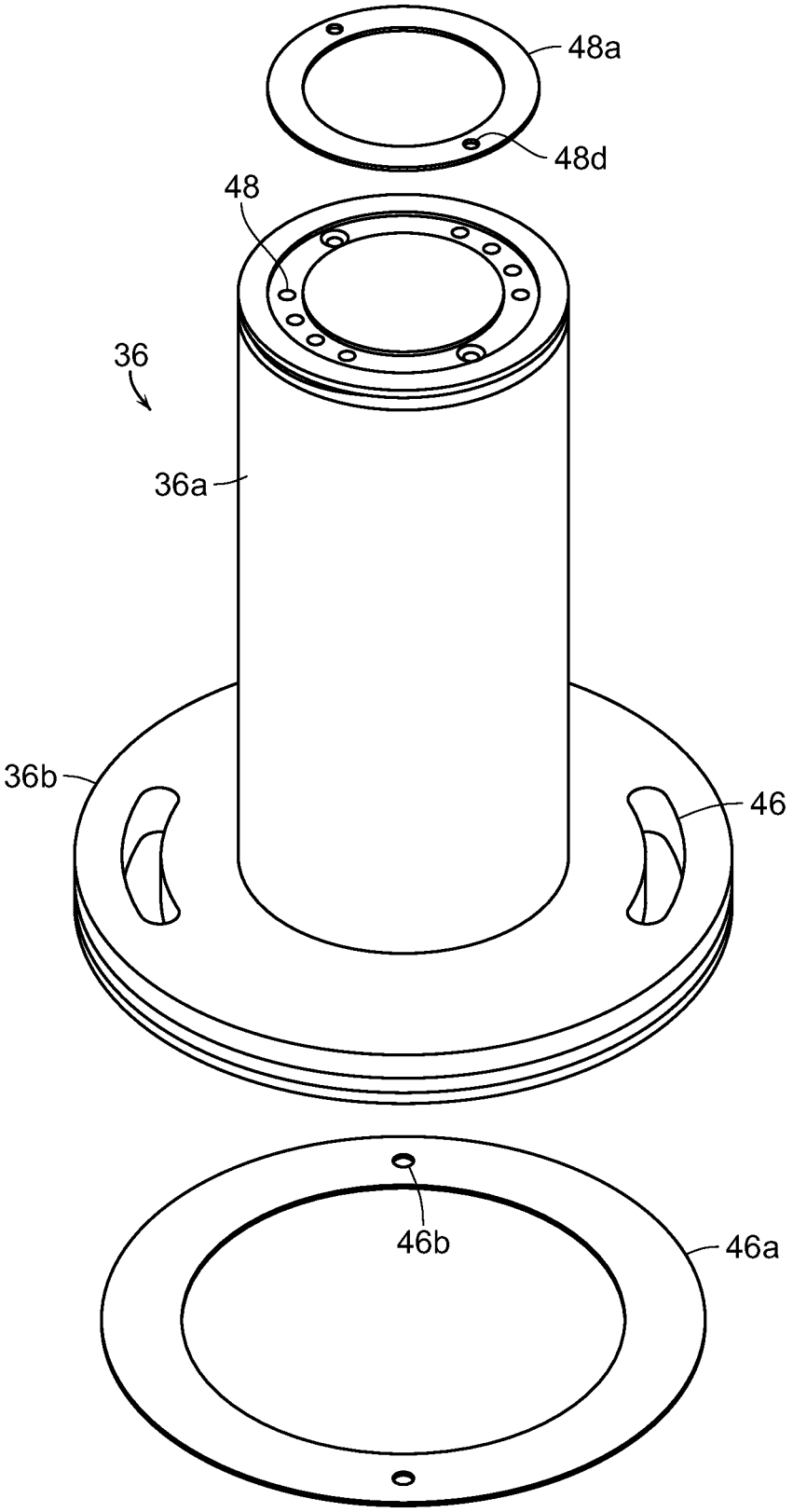
FIG. 7 is a cross-sectional, perspective view of the compressor cylinder of the dual engine-compressor system of the present invention.

As shown in FIG. 7, the compressor bore 34 includes a low-pressure chamber 38*a* and a high-pressure chamber 38*b*, wherein the low-pressure chamber 38*a* has a first diameter and the high-pressure chamber 38*b* has a second diameter larger than the low-pressure chamber 38*a*. With this configuration of diameters and having generally equal lengths, the low-pressure chamber 38*a* has a larger volume than the high-pressure chamber 38*b*. The compressor housing 32 preferably has a plurality of fins 44 provided around the outside. The fins 44 are for dissipating heat generated during the compression cycle. Such heat may arise from friction of the reciprocating pistons 36 against the inner walls of the bore 34. Heat may also be generated from the repeated and extreme compression of fluid that occurs during the compression process.

Figure 8:
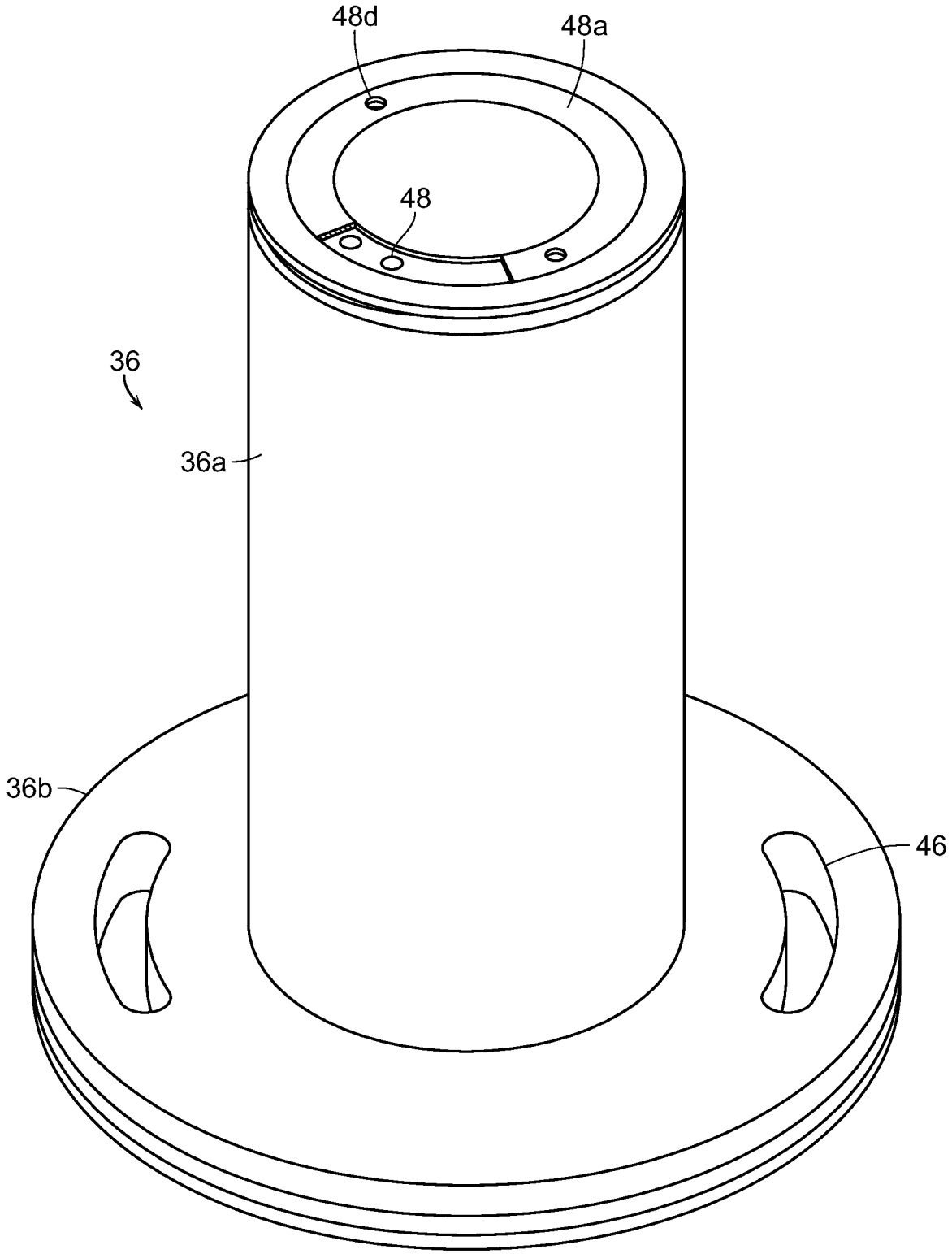
FIG. 8 is a perspective view of the air intake body for the compressor cylinder of the dual engine-compressor system of the present invention.

The low pressure chamber 38*a* has a fluid intake 40 proximate to the junction between the low-pressure chamber 38*a* and the high-pressure chamber 38*b*. As shown in FIGS. 3-6, the fluid intake 40 is preferably disposed in an annular ring 42 disposed around the compressor housing 32, which ring 42 is preferably filled with a porous, annular filter body 42*a* (FIG. 8). A reed valve 40*a* is associated with the fluid intake 40 to provide for selective passage of fluid through the fluid intake 40.

Figure 9:
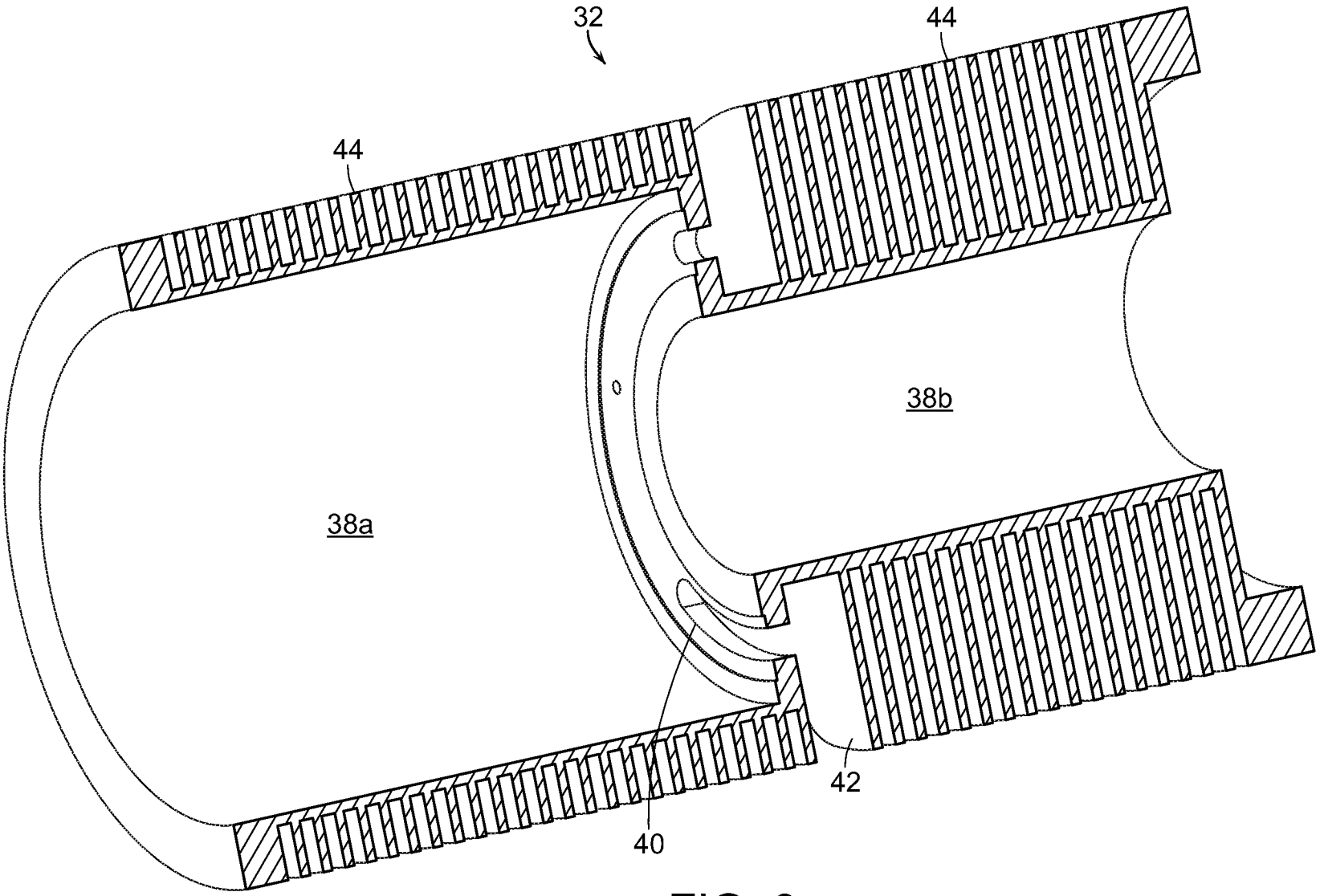
FIG. 9 is a partially exploded, perspective view of the compressor piston of the dual engine-compressor system of the present invention.
Figure 10:
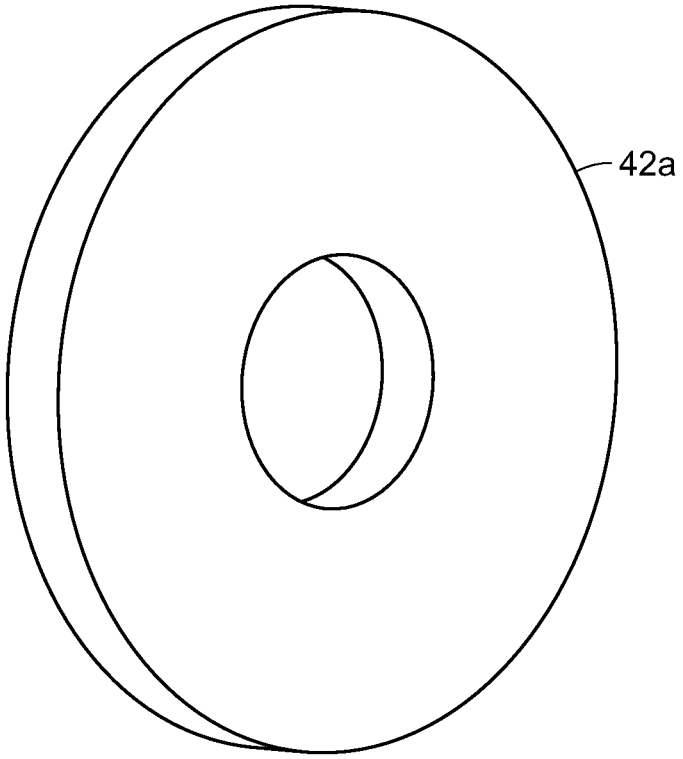
FIG. 10 is an assembled, perspective view of the compressor piston of the dual engine-compressor system of the present invention.

As shown in FIGS. 9 and 10, the compressor piston 36 comprises a cylindrical body 36*a* and a cylindrical cap 36*b*. The cylindrical body 36*a* has a diameter generally the equal to the second diameter of the high-pressure chamber 38*b*. The cylindrical cap 36*b* has a diameter generally equal to the first diameter of the low-pressure chamber 38*a*. The tolerances between the diameters of the compressor bore 34 and the compressor piston 36 are extremely small so as to create air-tight seals between the pistons 36 and the walls of the bore 34. The compressor piston 36 may also include O-rings 37 around the cylindrical body 36*a* and the cylindrical cap 36*b* to provide additional sealing.

As shown in FIGS. 9 and 10, the cylindrical cap 36*b* includes a low-pressure intake 46 to allow passage of fluid from a bottom-side of the cylindrical cap 36*b* to a top-side of the cylindrical cap 36*b*. A second reed valve 46*a* is associated with the low-pressure intake 46 to provide for selective passage of fluid through the low-pressure intake 46. A plurality of ports 48 pass through the compressor piston 36—from the top-side of the cylindrical cap 36*b* to the opposite end of the cylindrical body 36*a*—in the high-pressure compressor chamber 38*b*. A third reed valve 48*a* is associated with the plurality of ports 48 on the end of the cylindrical body 36*a* to provide for selective passage of fluid through the ports 48.

In operation, the compressor block 30 undergoes a 4-cycle process. The "starting" or bottom position of the compressor piston 36 is where the cylindrical body 36*a* is fully inserted into the high-pressure chamber 38*b*. The 4-cycle process begins with the first step—the first upstroke of withdrawing the cylindrical body 36*a* from the high-pressure chamber 38*b*, with the cylindrical cap 36*b* moving upward through the low-pressure chamber 38*a*. During this first upstroke, the first reed valve 40*a* activates and opens the fluid intake 40 such that fluid is drawn into the low-pressure chamber 38*a* beneath the cylindrical cap 36*b*.

Once the compressor piston 36 reaches the top position of the stroke, where the cylindrical body 36*a* is nearly fully withdrawn from the high-pressure chamber 38*b*, the compressor piston 36 begins the first downstroke—the second step of the 4-cycle process. The action of the first downstroke slightly compresses the fluid that was drawn into the low-pressure chamber 38*a* beneath the cylindrical cap 38*b*, so as to push the reed valve 40*a* against the fluid intake 40 so as to close the same. At the same time, the slight compression of the fluid also activates the second reed valve 46*a* so as to open the low-pressure intake 46, allowing the fluid to pass from the area of the low-pressure chamber 38*a* beneath the cylindrical cap 36*b* to the area of the low-pressure chamber 38*a* above the cylindrical cap 36*b*. At this point, all of the fluid that was drawn in through the fluid intake 40 during the first upstroke, is now in the low-pressure chamber 38*a* above the cylindrical cap 38*b*.

Once the compressor piston 36 reaches the bottom position of the stroke, where the cylindrical body 36*a* is again fully inserted into the high-pressure chamber 38*b*, the compressor piston 36 begins the second upstroke—the third step of the 4-cycle process. The action of the second upstroke slightly compresses the fluid that was drawn into the low-pressure chamber 38*a* above the cylindrical cap 36*b*, pushing the second reed valve 46*a* against the low-pressure intake 46 so as to close the same. At the same time, the slight compression of the fluid also activates the third reed valve 48*a* opening the ports 48 through the compression piston 36, allowing the fluid to pass from the low-pressure chamber 38*a* above the cylindrical cap 26*b* to the high-pressure chamber 38*b* below the compression piston 36.

At the same time, as the first step of a parallel 4-cycle process, the upstroke again activates the first reed valve 40*a* to open the fluid intake 40 and draw a second volume of fluid into the low-pressure chamber 38*a* below the cylindrical cap 36*b*, as described above.

Once the compressor piston 36 reaches the top position of the stroke for the second time, where the cylindrical body 36*a* is nearly fully withdrawn from the high-pressure chamber 38*b*, the compressor piston 36 begins the second downstroke—the fourth step of the 4-cycle process. The action of the second downstroke compresses the fluid that was drawn into the high-pressure chamber 38*b* beneath the compressor piston 36, pushing the third reed valve 48*a* against the ports 48 so as to close the same. Since the volume of fluid that was previously in the low-pressure chamber 38*a* with a comparatively larger diameter and volume is now contained in the high-pressure chamber 38*b* with a comparatively smaller diameter and volume, the corresponding compression is significantly greater. When the compressor piston 36 reaches the bottom position for the second time in a cycle, the fluid in the high-pressure chamber 38*b* is fully and significantly compressed. The significantly compressed fluid is then released through a high-pressure outlet 56 in the bottom of the high-pressure chamber 38*b*.

At the same time, as the second step of a parallel 4-cycle process, the second downstroke of the cycle also moves the second volume of fluid from the area of the low-pressure chamber 38*a* beneath the cylindrical cap 36*b* to the area of the low-pressure chamber 38*a* above the cylindrical cap 36*b*, as described above. The parallel 4-cycle process is completed with the third and fourth steps, as described above. As with similar 4-cycle systems, the 4-cycle process repeats in overlapping parallel processes as long as the crankshaft turns and the pistons reciprocate.

Figure 11:
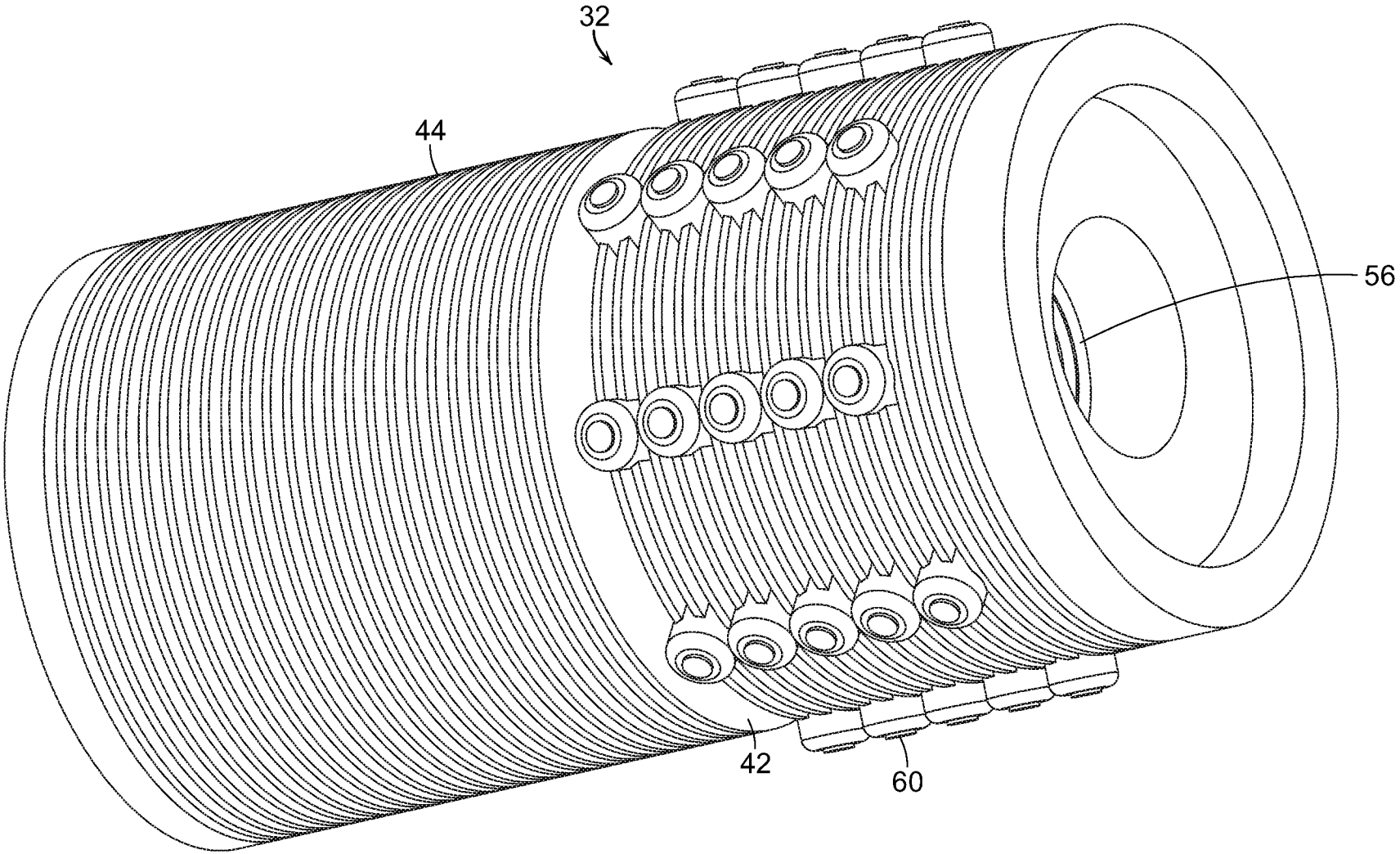
FIG. 11 is a perspective view of the compressor cylinder with a plurality of pick-ups of the dual engine-compressor system of the present invention.
Figure 12:
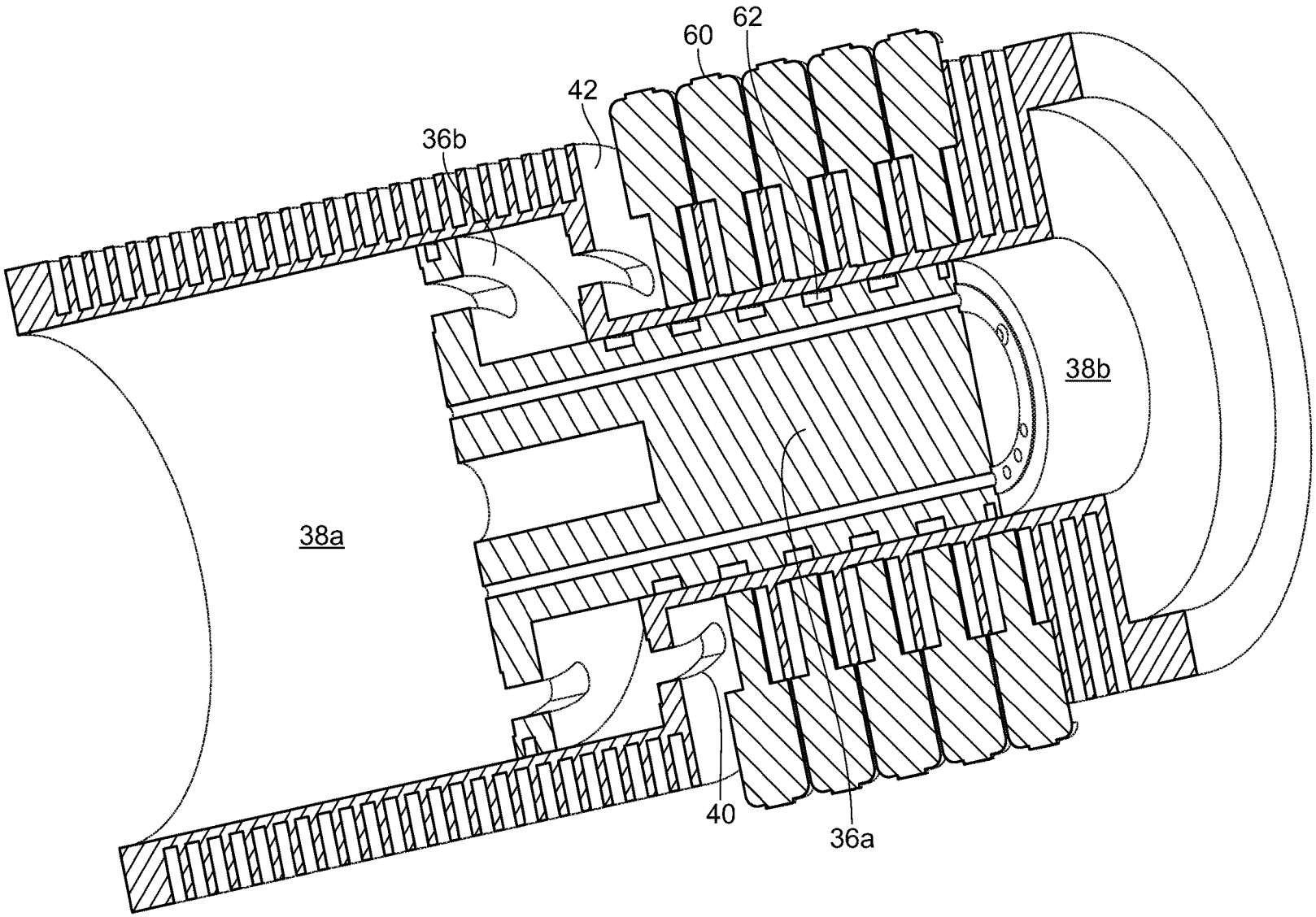
FIG. 12 is a cross-sectional, perspective view of the compressor cylinder with a plurality of pick-ups of the dual engine-compressor system of the present invention.
Figure 13:
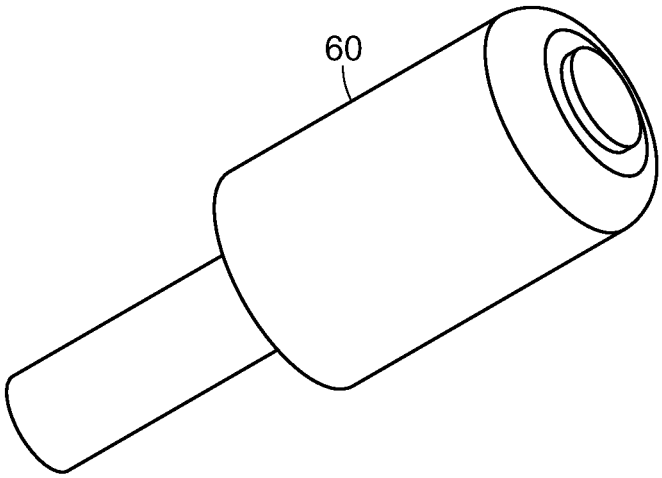
FIG. 13 is a perspective view of a pick-up of the dual engine-compressor system of the present invention.
Figure 14:
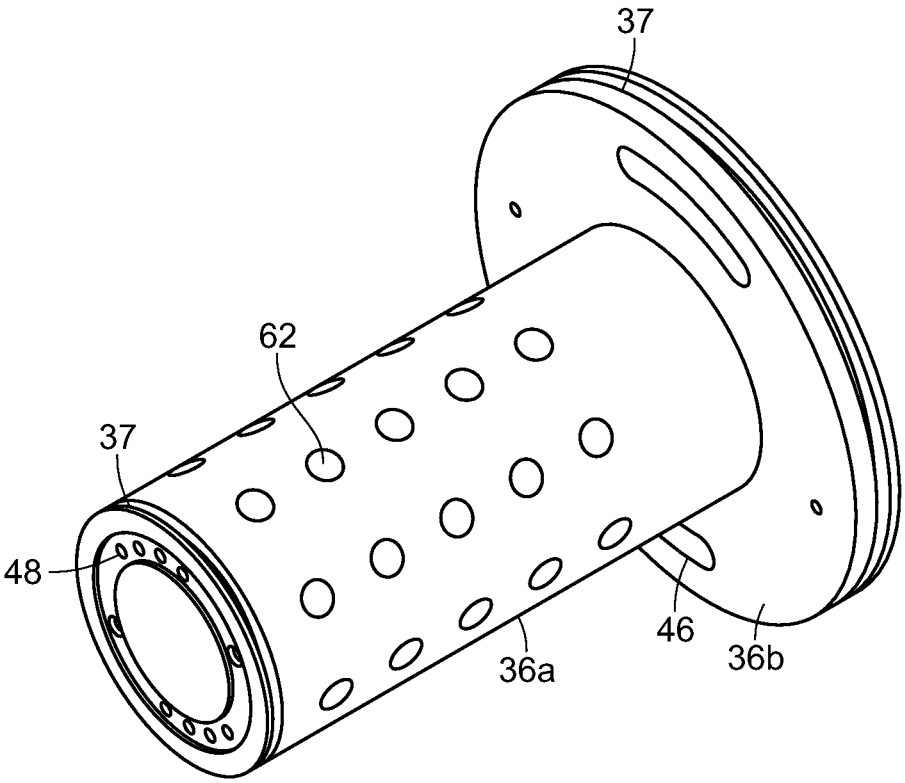
FIG. 14 is a perspective view of the compressor piston with a plurality of magnetic discs of the dual engine-compressor system of the present invention.

FIGS. 11-14 illustrate a further improvement to the compressor block 30. In FIG. 11, the compressor housing 32 is shown to have a plurality of pick-ups 60 disposed around the perimeter, preferably arranged in lines of multiple pick-ups 60. As shown in FIG. 12, the pick-ups 60 extend through the fins 44 and terminate at the wall of the high-pressure chamber 38*b*. FIG. 13 shows an individual pick-up 60 as it appears separate from the compressor housing 32. As shown in FIG. 14, the cylindrical body 36*a* of the piston 36 has a plurality of magnetic discs 62—preferably strong rare-earth magnets—disposed around the piston 36. These magnetic discs 62 are preferably positioned beneath the pick-ups 60. As the piston 36 reciprocates during the on-going 4-cycle process, the movement of the pick-ups 60 relative to the magnetic discs 62 generates electrical current, such that the compressor block 30 not only compresses fluid, but generates electricity.

Figure 15:
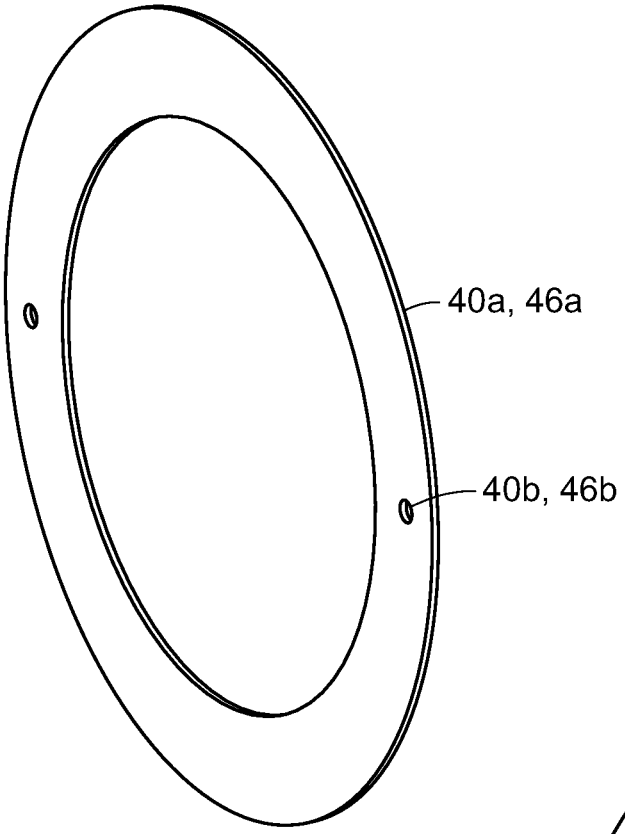
FIG. 15 is a perspective view of a preferred embodiment of a reed valve for the fluid intake and low-pressure intake of the dual engine-compressor system of the present invention.
Figure 16:
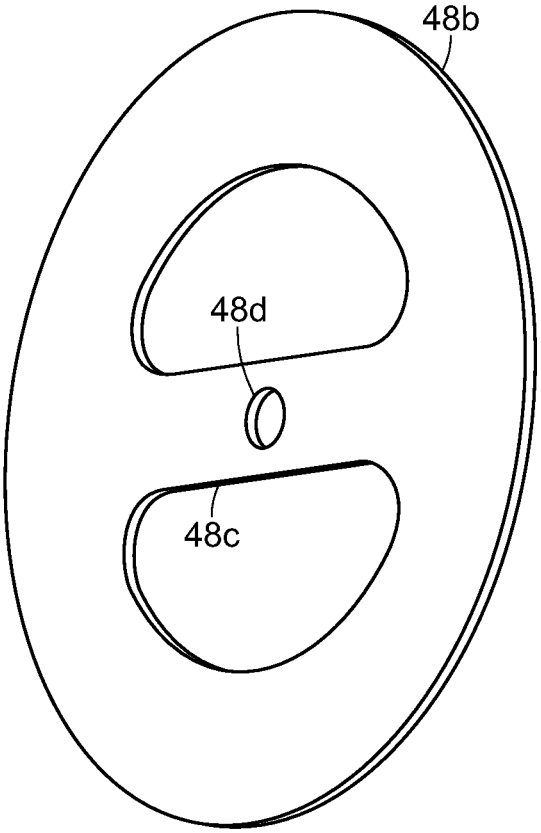
FIG. 16 is a perspective view of a preferred embodiment of a reed valve for the high-pressure ports of the dual engine-compressor system of the present invention.
Figure 17:
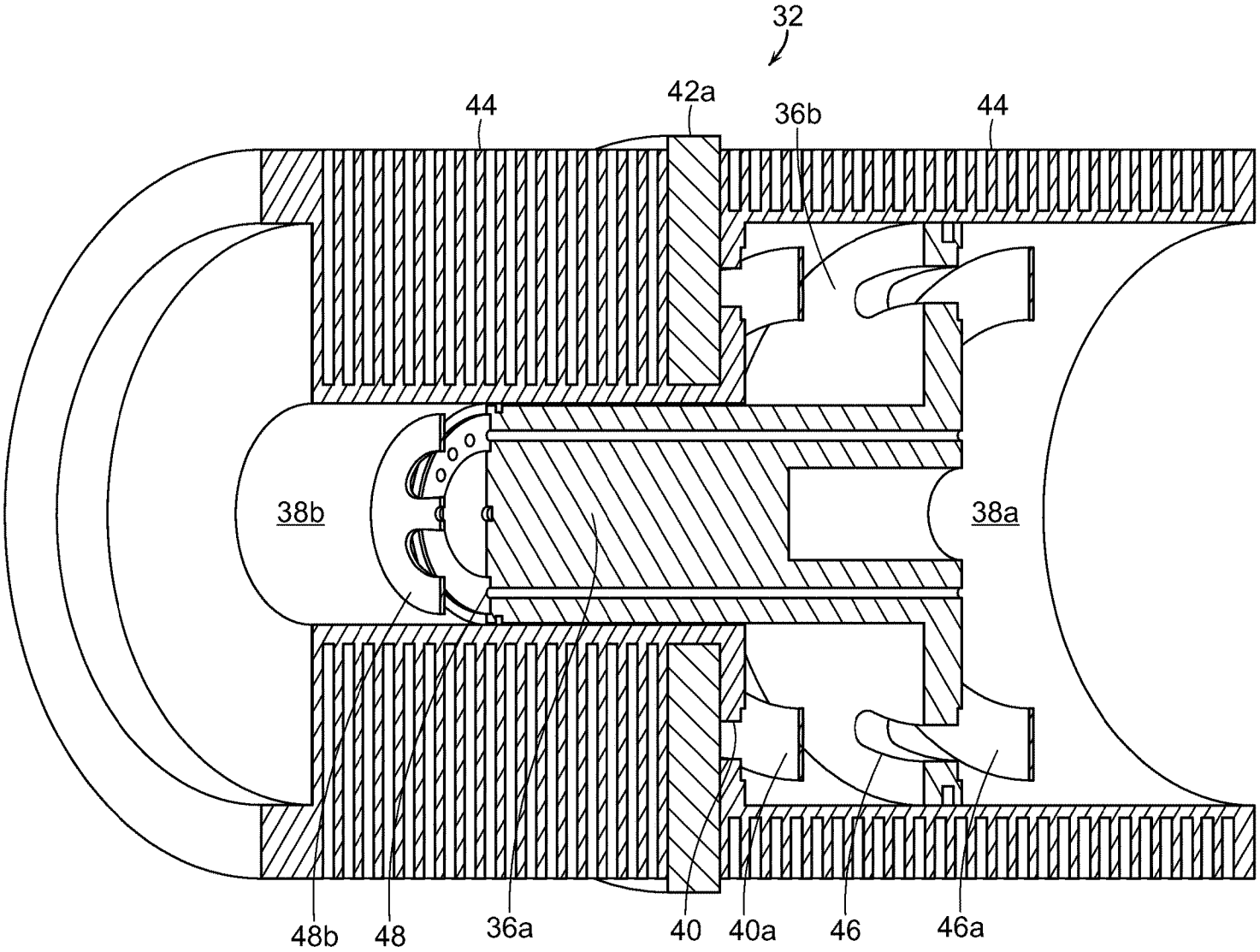
FIG. 17 is a cross-sectional, partially exploded view of the compressor cylinder and compressor piston with the preferred reed valves of the dual engine-compressor system of the present invention.

FIGS. 15-17 illustrate certain preferred embodiments for the reed valves. Specifically, FIG. 15 shows a reed valve 40*a*, 46*a* for use with either the fluid intake 40 or the low-pressure intake 46. The reed valve 40*a*, 46*a* is generally circular to match the shape of the compressor chamber 38 or the cylindrical cap 36*b*, and includes a pair of oppositely disposed bolt holes 40*b*, 46*b* or similar mechanism for attachment. While the reed valve 40*a*, 46*a* may be attached to either the inner surface of the fluid intake 40 or the low-pressure intake 46, such attachment is sufficiently loose to allow the reed valve 40*a*, 46*a* to alternate between an abutting relationship or a spaced relationship with the corresponding intake 40, 46. This is how the reed valve 40*a*, 46*a* works to open or close the corresponding intake 40, 46.

FIG. 16 shows an alternate embodiment reed valve 48*b* for use with the high-pressure ports 48 on the compressor piston 36. In previously described embodiments (FIGS. 5, 6, 9, and 10), the reed valve 48*a* was shown as a generally circular ring similar to the reed valve 40*a*, 46*a* in FIG. 15. The alternate embodiment for a reed valve 48*b* shown in FIG. 16 is also generally circular, but includes a central support 48*c*. This central support 48*c* includes a bolt hole 48*d* or similar mechanism for attachment, that functions as the bolt holes 40*b*, 46*b* described above. FIG. 17 shows a partially exploded cross-section of the compressor housing 32 with the compressor piston 36 and corresponding reed valves 40*a*, 46*a*, 48*b* (the alternate embodiment.

The inventive system is completely scalable from nano-sized engines to large stationary engines. The construction has a reduced demand for lubricating oils and completely eliminates oil from the combustion chambers. It also requires reduced fuel usage when compared to typical combustion engines. The system is able to operate either by compression or combustion. It can be either air cooled or water cooled. There is a low production cost because of fewer and less diverse parts. The system can also serve as a power plant to drive an electrical generator, while providing both air and liquid compression.

The system has application in many fields, including, home generators, commercial/industrial generators, stand-alone use for remote locations, trailer mounted to airport tarmac use, emergency short term and long term use, aviation, un-manned military aviation, ultra-light personal aviation, motor vehicle compressors, engines, motorcycles, kit vehicles, golf carts, heavy diesel engines, marine vessels, military vehicles, agriculture pumps, lifts and winches, and an off-grid power supply.

The system can be manufactured from carbon fiber housing and crankcase, with a steel alloy crankshaft. Fuel injector design allows for use with gasoline, diesel, propane, or practically any other liquid or gaseous fuel. The system is low profile with a high power-to-weight ratio. It can be air cooled or water cooled and use pressurized lubrication in the crankcase, with no lubrication required in the cylinders. It can use an electric start/ignition and power system. Calculated performance can reach as much as 1 hp per cubic inch-330 hp @3000 rpm, with usable torque as high as 450 ft-lb @ 2000 rpm.

Figure 18:
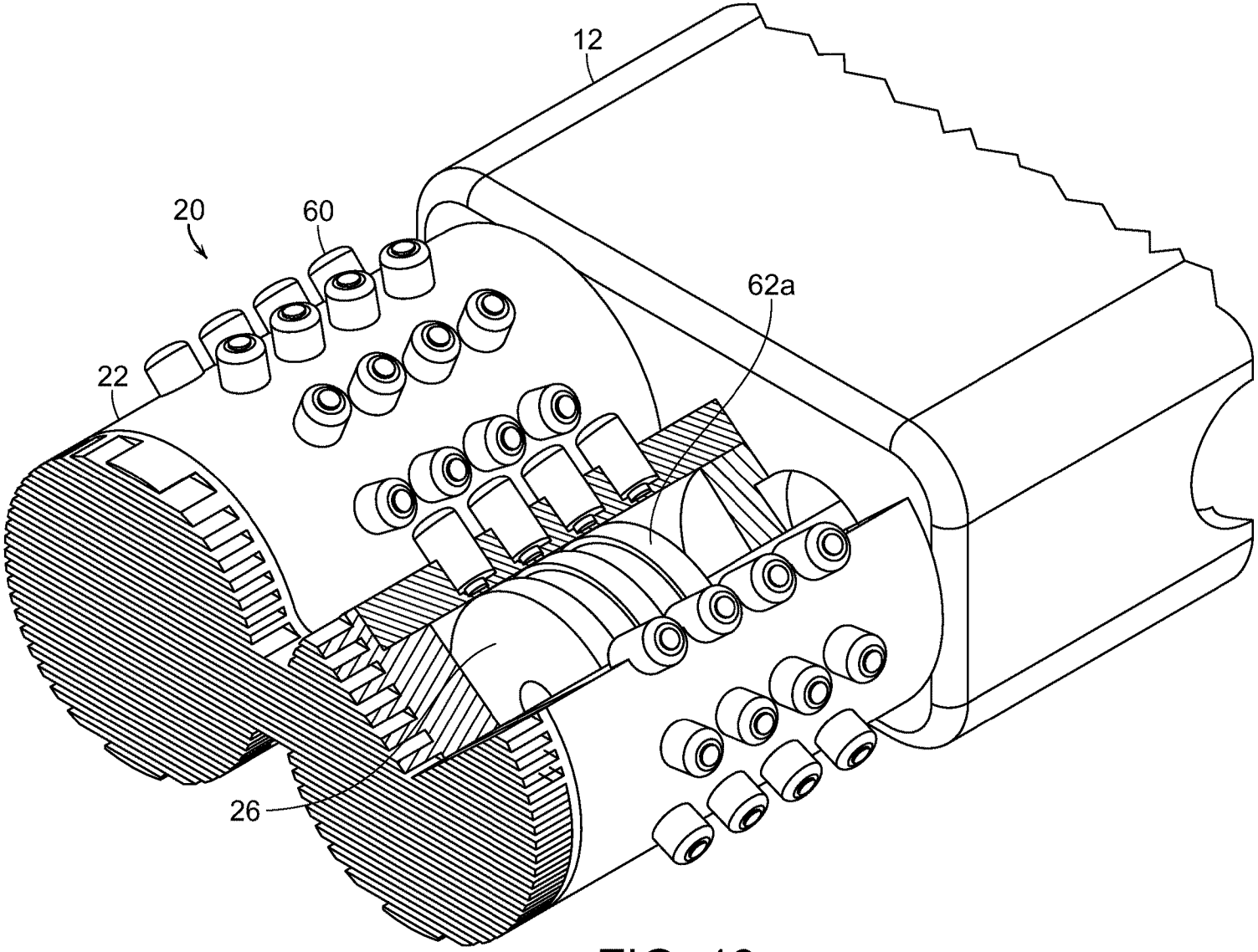
FIG. 18 is a close-up, partial cut-away view of the crankcase and engine side of the dual engine-compressor system of the present invention.

FIGS. 18-21 illustrate alternate embodiments for the combustion side 20 of the inventive system 10. In these alternate embodiments, the combustion side 20 is outfitted with magnets and pick-ups to create a generator. Specifically, FIG. 18 shows a cylinder housing 22 of the engine side 20 having a plurality of pick-ups 60 arranged around the perimeter of the housing 22 similar to that described above for the compressor housing 32. One of the cylinder housings 22 is shown in partial cut-away to expose the piston 26 inside. The piston 26 is shown with a plurality of magnetic rings 62*a* surrounding the perimeter of the piston 26. The piston 26 may have two or more ring magnets 62*a*. The rings 62*a* are preferably made from rare earth magnets or similar materials as the magnets 62 described above. The ring magnets 62*a* allow for easier assembly as the piston 26 can be installed in any orientation without concern for aligning the row of magnets 62 with a row of pickups 60.

Figure 19:
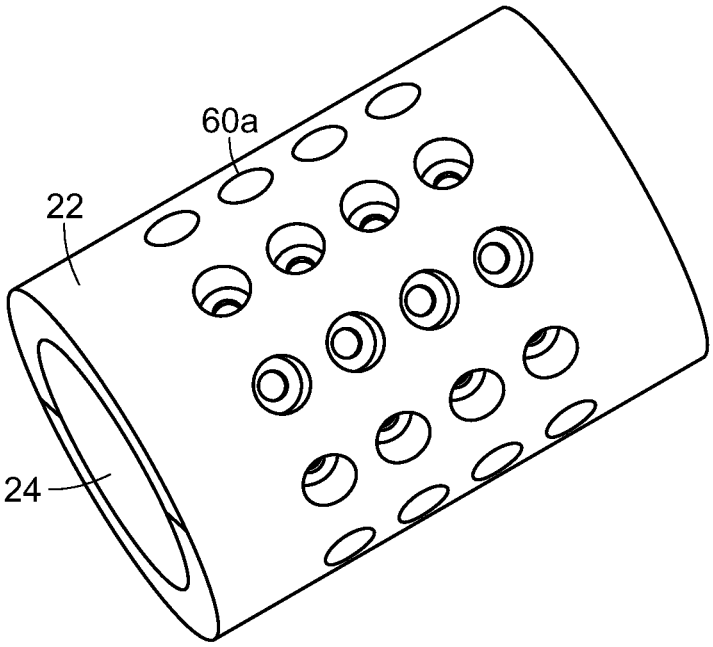
FIG. 19 is perspective view of an alternate embodiment of the cylinder from the engine side of the dual engine-compressor system of the present invention.

FIG. 19 shows the combustion cylinder 22 having a plurality of openings 60*a* designed to accommodate the pick-ups 60 described above. These openings 60*a* allow for the pick-ups 60 to extend through the housing and present a more reliable point of interaction with the magnets 62*a*. When installed, the pick-ups 60 must be reliably sealed in the openings 60*a* to allow for the pressure experienced in a combustion cylinder 22.

Figure 20:
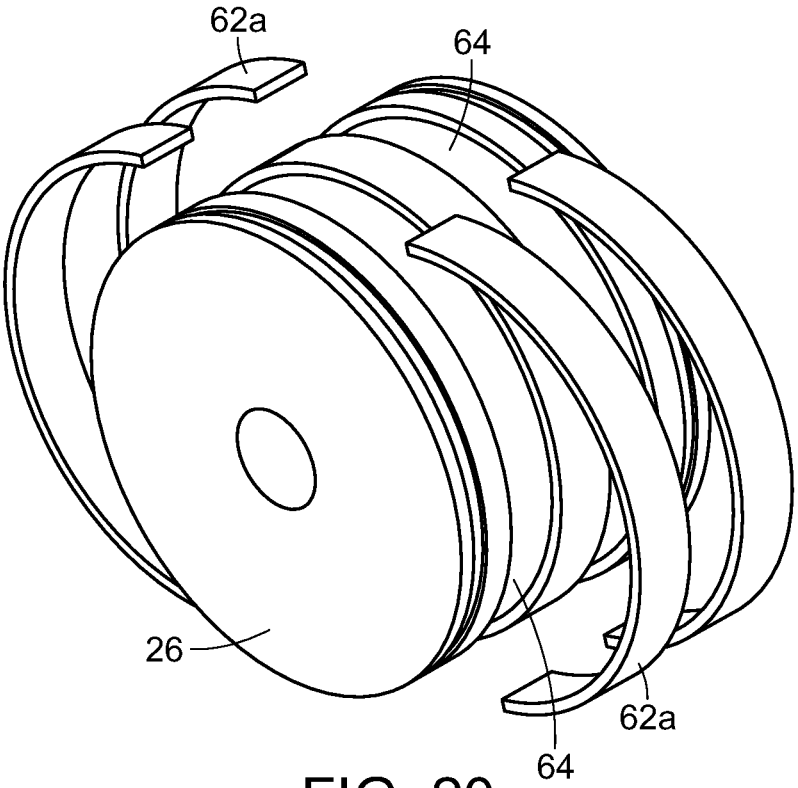
FIG. 20 is a perspective view of an alternate embodiment of the combustion piston from the engine side of the dual engine-compressor system of the present invention.

FIG. 20 shows an alternate embodiment of a combustion piston 26 showing the ring magnets 62*a*. As is shown, the ring magnets 62*a* are preferably in multiple positions along the length of the piston 26. The ring magnets 62*a* are preferably split into two halves with opposite polarities on the ends. In this way, the split halves of the ring magnets 62*a* can be held in place in grooves 64 by their own magnetism, without the need for adhesives or other bonding agents. The use of multiple rings magnets 62*a* increases the number of interactions between magnets and pick-ups, thus, increasing the electrical generating capacity of the system 10.

Figure 21:
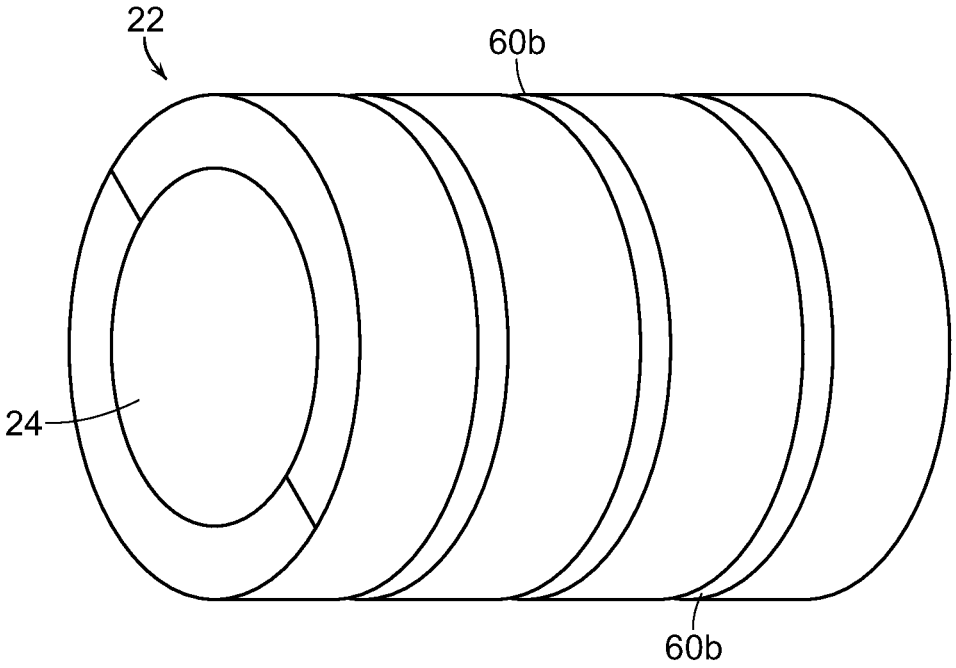
FIG. 21 is a perspective view of another alternate embodiment of the cylinder from the engine side of the dual engine-compressor system of the present invention.

FIG. 21 shows an alternate embodiment of the combustion cylinder 22, wherein, instead of a plurality of linearly arranged pick-ups 60, the cylinder 22 has a plurality of pick-up rings 60*b*. The plurality of pick-up rings 60*a* are disposed around the perimeter of the cylinder and spaced along the length of the cylinder 22. These pick-up rings 60*b* can be used in combination with either a plurality of magnets 62 or a plurality of ring magnets 62*a* on the piston 26. As with the ring magnets 62*a*, the ring pick-ups 60*b* provide for easier assembly as there is no need to align a row of magnets 62 with a row of pick-ups 60.

Although several embodiments have been described in detail for purposes of illustration, various modifications may be made without departing from the scope and spirit of the invention. Accordingly, the invention is not to be limited, except as by the appended claims.

What is claimed is:

1. A dual engine-compressor system, comprising:

a crankcase enclosing a crankshaft;

a first engine cylinder housing disposed on a first side of the crankcase and defining a first engine bore;

a first combustion piston reciprocatingly disposed in the first engine bore and defining alternating combustion chambers within the first engine bore on opposite sides of the first combustion piston;

a first compressor cylinder housing disposed on an opposite second side of the crankcase and defining a first compressor bore;

a first compressor piston reciprocatingly disposed in the first compressor bore and defining alternating compressor chambers within the first compressor bore on opposite sides of the first compressor piston;

a first combustion rod connecting the first combustion piston to a first scotch yoke on the crankshaft and a first compressor rod connecting the first compressor piston to the first scotch yoke, wherein the first combustion rod and the first compressor rod are oriented in a generally linear relationship;

wherein the alternating compressor chambers in the first compressor bore comprise a low-pressure chamber and a high-pressure chamber, said low pressure chamber having a first diameter and said high-pressure chamber having a second diameter smaller than the first diameter; and wherein the first compressor piston has a cylindrical body and a cylindrical cap, the cylindrical body having a diameter equal to the second diameter of the high-pressure chamber and the cylindrical cap having a diameter equal to the first diameter of the low-pressure chamber.

2. The dual engine-compressor system of claim 1, further comprising a fluid intake in the low-pressure chamber of the first compressor housing adjacent to the high-pressure chamber and an intake reed valve associated with the fluid intake, wherein the intake reed valve is configured to open the fluid intake on an upstroke of the first compressor piston and close the fluid intake on a downstroke of the first compressor piston.

3. The dual engine-compressor system of claim 1, further comprising a low-pressure intake through the cylindrical cap of the first compressor piston and a low-pressure reed valve associated with the low-pressure intake, wherein the low-pressure reed valve is configured to open the low-pressure intake on a downstroke of the first compressor piston and close the low-pressure intake on an upstroke of the first compressor piston.

4. The dual engine-compressor system of claim 1, further comprising a high-pressure intake through the cylindrical body of the first compressor piston and a high-pressure reed valve associated with the high-pressure intake, wherein the high-pressure reed valve is configured to open the high-pressure intake on an upstroke of the first compressor piston and close the high-pressure intake on a downstroke of the first compressor piston.

5. The dual engine-compressor system of claim 1, wherein the first compressor piston is configured to reciprocate between an upstroke position, with the first compressor piston substantially in the low-pressure chamber, and a downstroke position, with the first compressor piston substantially in the high-pressure chamber.

6. The dual engine-compressor system of claim 5, wherein movement of the first compressor piston from the downstroke position to the upstroke position causes compressor fluid to be drawn through a fluid intake from outside the first compressor housing into the low-pressure chamber.

7. The dual engine-compressor system of claim 6, wherein movement of the first compressor piston from the upstroke position to the downstroke position causes compressor fluid to be forced through a low-pressure intake from one side of the cylindrical cap to another side of the cylindrical cap.

8. The dual engine-compressor system of claim 7, wherein movement of the first compressor piston from the downstroke position to the upstroke position causes compressor fluid to be forced through a high-pressure intake from the low-pressure chamber to the high-pressure chamber.

9. The dual engine-compressor system of claim 8, wherein movement of the first compressor piston from the upstroke position to the downstroke position causes compressor fluid in the high-pressure chamber behind the cylindrical body to be compressed until released through a compressor outlet.

10. The dual engine-compressor system of claim 1, wherein the first compressor piston has a plurality of magnets disposed around a perimeter of the cylindrical body and the first compressor cylinder housing has a plurality of pick-ups disposed around the high-pressure chamber, such that each of the plurality of magnets is associated with at least one of the plurality of pick-ups.

11. The dual engine-compressor system of claim 1, further comprising a second engine cylinder housing also disposed on the first side of the crankcase and defining a second engine bore; and a second combustion piston reciprocatingly disposed in the second engine bore and defining alternating combustion chambers within the second engine bore on opposite sides of the second combustion piston.

12. The dual engine-compressor system of claim 11, further comprising a second compressor cylinder housing also disposed on the second side of the crankcase and defining a second compressor bore; and a second compressor piston reciprocatingly disposed in the second compressor bore and defining alternating compressor chambers within the second compressor bore on opposite sides of the second compressor piston.

13. The dual engine-compressor system of claim 12, further comprising a second combustion rod connecting the second combustion piston to a second scotch yoke on the crankshaft and a second compressor rod connecting the second compressor piston to the second scotch yoke, wherein the second combustion rod and the second compressor rod are oriented in a generally linear relationship.

* * * * *